US006820799B2

(12) United States Patent
Makofsky et al.

(10) Patent No.: US 6,820,799 B2
(45) Date of Patent: Nov. 23, 2004

(54) EXPANDABLE ENVELOPE CONSTRUCTION

(75) Inventors: Marvin A. Makofsky, Sand Point, NY (US); Jerome B. Schwartz, Mineola, NY (US)

(73) Assignee: Pama Enterprises, Inc., Great Neck, NY (US)

( * ) Notice: Subject to any disclaimer, the term of this patent is extended or adjusted under 35 U.S.C. 154(b) by 58 days.

(21) Appl. No.: 10/417,772

(22) Filed: Apr. 17, 2003

(65) Prior Publication Data

US 2003/0183680 A1 Oct. 2, 2003

Related U.S. Application Data

(60) Division of application No. 09/764,922, filed on Jan. 18, 2001, now Pat. No. 6,564,994, which is a continuation-in-part of application No. 09/506,126, filed on Feb. 17, 2000, now Pat. No. 6,227,444.

(51) Int. Cl.[7] ..... B65D 27/00
(52) U.S. Cl. ..... 229/68.1; 229/75; 229/928
(58) Field of Search ..... 229/68.1, 75, 928

(56) References Cited

U.S. PATENT DOCUMENTS 2,364,297 A * 12/1944 James ..... 229/87.19
6,109,511 A * 8/2000 Schluger ..... 229/103.2
6,227,444 B1 * 5/2001 Makoesky et al. ..... 229/313
6,564,994 B2 * 5/2003 Makofsky et al. ..... 229/313

* cited by examiner

*Primary Examiner*—Jes F. Pascua
(74) *Attorney, Agent, or Firm*—Francis C. Hand; Carell, Byrne, Bain et al

(57) ABSTRACT

A single blank is used to make an expandable envelope construction having four side edges which can expand as the envelope construction is filled to capacity. The blank is provided with horizontal and vertical score lines and fold lines which permit the sides and bottom of the construction to collapse inwardly while the pocket enlarges in thickness and decreases in height and width. The blank has side flaps with corners at the ends which are overlaid by the back panel and closure panel in an unsecured manner to maintain the envelope in a sealed condition when expanded.

7 Claims, 11 Drawing Sheets

EXPANDABLE ENVELOPE CONSTRUCTION

This application is a division of Ser. No. 09/764,922 filed Jan. 18, 2001 now U.S. Pat. No. 6,564,994 which is a continuation-in-part of application Ser. No. 09/506,126, filed Feb. 17, 2000, now U.S. Pat. No. 6,227,444.

This invention relates to an expandable envelope construction.

As is known, envelopes have been constructed for a number of purposes, for example, for the mailing of letters, business correspondence, merchandise, such as CD carriers and the like through the mails and thus need to conform to specified size requirements. Envelopes have also been constructed for use in the filing of various types of materials and in some cases, have been constructed to expand in order to increase the capacity of the envelope. Generally, these envelopes have been glued and finished by hand. In addition, these envelopes have had an internal gusset construction which restricts the insertion of papers.

Typically, the degree to which an expandable envelope can be expanded has been limited. Further, should an envelope become overstuffed, the edges tend to become rounded with the appearance of the envelope becoming less than aesthetically pleasing.

U.S. Design Pat. No. 405,823 illustrates an envelope for commercial literature which has tapered edges on three sides and an enlarged pocket. In addition, a pair of flaps are illustrated, with at least one flap providing for closure of the pocket.

An expandable envelope construction is also known for shipping CDs wherein the front and back are each provided with score lines spaced inwardly of the edges in order to permit the envelope to expand upon the insertion of a CD holder while retaining a flat appearance. The envelope is made from a blank having a rectangular panel to form the face of the envelope and from which trapezoidal shaped flaps extend from two sides, a second panel extends from the bottom to eventually form part of the back of the envelope and a closure flap extends from the top. The back panel folds over the face panel as well as over the side flaps to form a pocket. In addition, the back panel has a trapezoidal shaped section with edges which face the edges of the side flaps when the envelope is empty and flat. The closure flap has similar edges to face the side flaps at the top corners. However, when the envelope is stuffed, the corners of the envelope tend to open. As a result not only arc the contents not completely sealed from the outside environment but also the appearance of the back of the envelope is less than desirable.

Accordingly, it is an object of this invention to provide an aesthetically pleasing envelope construction which is of an expandable nature.

It is another object of the invention to provide an expandable envelope construction which can be readily fabricated on automated equipment.

It is another object of the invention to provide a flat expandable envelope construction which can be filled to capacity while retaining the contents in a fully sealed condition while retaining a flat appearance.

It is another object of the invention to provide an expandable envelope that may be opened to remove the contents and re-closed after refilling with all or some of the contents.

It is another object of the invention to provide an expandable envelope of corrugated construction which can be used as a re-useable envelope.

It is another object of the invention to provide an expandable envelope which can be mechanically stuffed and closed.

Briefly, the invention is directed to an expandable envelope construction comprising a rectangular front panel, a pair of side flaps at opposite sides of the front panel for folding over the front panel along a vertical fold line, a back panel disposed over the front panel to form a pocket and a closure flap for folding over the back panel to close the pocket. In addition, at least the back panel and the flaps are provided with score lines to allow for expansion of the pocket while maintaining the flat appearance of the envelope.

In accordance with the invention, each side flap includes a first section which extends from a respective vertical fold line and a reduced second section which extends from the first section. In addition, the back panel is secured to the second section of each of the folded-over side flaps between the score lines by means of an adhesive on the flaps to form a pocket. The back panel has a trapezoidal section extending from the horizontal fold line in overlying unsecured relation to the first section of each side flap. Likewise, the closure flap extends over the first section of each flap in an unsecured manner. Thus, upon insertion of materials into the pocket, the panels are expandable from each other to enlarge the thickness of the pocket while the corners of the pocket also expand while being maintained in a sealed condition.

In one embodiment, the front panel is also provided with score lines along each edge so as to be capable of expanding in the same manner as the back panel. This envelope construction is such that, upon insertion of materials into the pocket, the front and back faces expand from each other while the two sides and the bottom of the envelope construction collapse inwardly about the respective pairs of score lines adjacent the fold lines on each edge of the envelope construction. For example, for an envelope construction intended to have a thickness capacity of one-half inch, the score lines are spaced one-half inch from the adjacent fold line. The envelope may then be expanded from an empty flat condition to one in which the pocket is one-half inch thick while retaining a flat appearance.

After materials have been introduced into the pocket of the envelope construction, the closure flap is folded over the back face to close the pocket. In one embodiment, the closure flap is provided with means for securing the closure flap to the back panel. For example, the means for securing the closure flap may include an adhesive strip along an inside edge of the closure flap and a removable barrier strip over the adhesive strip. Upon removal of the barrier strip, the adhesive strip is exposed for sealing purposes.

The closure flap may also include a horizontally disposed removable strip which, upon removal, unseals the remainder of the closure flap from the back panel of the envelope construction so that the contents of the pocket may be removed. In order to facilitate removal of the strip, a tab is provided at one end of the strip to extend beyond the closure flap for manual or mechanical gripping. For purposes of mechanical stuffing and closing of the envelope construction, the tab may be disposed on one side or the other of the envelope construction. Further, the removable strip may terminate short of one edge of the closure flap.

In another embodiment, the envelope construction may have means on the closure flap between the removable strip and the front panel for reclosing the closure flap over the back panel. Such a reclosing means may be in the form of a ribbon for wrapping about the panels or may be in the form of an adhesive strip which is covered over by a releasable barrier strip or in the form of Velcro strips or elements which cooperate with Velcro elements on the back panel.

The envelope construction may be made in various sizes and materials in order to accommodate various materials to be retained in the pocket. For example, the envelope construction may be sized to receive letter size sheets of paper, magazines, catalogs and the like. The envelope construction may also be made of smaller sizes, for example, to receive and ship CD carriers, and of larger sizes, for example, to receive three-ring binders.

In one embodiment, the envelope is made with an overall size of 10 inches by 7 inches with expansion score lines on only the back panel, side flap and closure flap. In this embodiment, the front panel is smooth and uninterrupted with score lines. This is so that the mailing side of the envelope construction does not show scores.

In another embodiment, the envelope construction may have a size of 10½ inches by 7½ inches with the front panel having a window for viewing of an address on the materials within the pocket. Typically, a glassine patch would be secured to an inside surface the front panel over the window to protect the contents of the pocket. Such an envelope may be used to include a packet of materials with a wrap-around letter with an address on the letter showing through the window. In this embodiment, the material of the envelope construction may be made of an E or F fluted corrugated material to add strength where needed.

Depending on the capacity required of an envelope construction, the size of the envelope and the dimensions of the scores may vary.

In still another embodiment, the envelope construction may be made of embossed material. Such a construction is particularly of interest when containing folders or other envelopes of similar embossed construction. For example, the envelope construction may have dimensions of 13 inches by 10¼ inches so as to be matched for insertion of a 12 inch by 9½ inch folder. Such a dimensional relationship allows the folder to be mailed without being damaged.

In still another embodiment, the back panel may be provided with a horizontally disposed slot while the closure flap is made of a length to be inserted into the slot upon closing of the pocket. In this embodiment, the closure flap is not sealed to the back panel but is instead removably held in place. Such an embodiment is particularly useful as a folder.

In still another embodiment, the envelope construction may be sized for mechanical or automatic insertion equipment. For example, a size of 11⅞ inches by 9⅜ inches is particularly suited to such equipment. In such an embodiment, the equipment would insert 8½ inch by 11 inch booklets or pamphlets up to ⅜ inch thickness into the pockets of the envelope constructions. The size of the envelope and the thickness for insertion of materials may vary by being bigger or smaller depending upon the customer's needs.

Adhesive may also be applied mechanically to seal the envelope construction. In this case, the tab on the removable strip in the closure flap may project from one side or the other side of the closure flap to enable an inserting arm that lifts the flap not to jam as the envelope construction passes through the mechanical device. Further, with this embodiment, the expansion scores may be double scored to allow for easier opening of the closure flap for mechanical insertions.

In still another embodiment, the envelope construction may be sized and made of materials suitable for use as a mailing container. For example, an envelope construction having dimensions of 14⅝ inches by 13⅜ inches may be used to receive a 1 inch thick three-ring binder. In this case, the paper used would be a F-flute corrugated material or an E-flute corrugated material or similar stiff material.

In still another embodiment, the envelope construction may be made for reuse, as a carrying case. For example, cooperating Velcro elements may be placed on the closure flap and the back panel for releasably securing the closure flap to the back panel. In addition, each of the front panel and closure flap may be provided with a hinged blank which can be punched out and folded back to form a handle.

In another embodiment, the expandable envelope construction may be made with a rectangular front panel having horizontal and vertical score lines as above with angularly disposed score lines extending to a respective corner of the panel. In addition, a pair of flaps are disposed at opposite sides of the front panel with each flap being folded over along a vertical fold line. In this embodiment, a back panel extends from and is folded over the front panel along a horizontal fold line and is secured to the flaps to define a pocket. The back panel is also provided with horizontal and vertical score lines as well as angularly disposed score lines extending from the intersection of a horizontal and vertical score line to a corner of the back panel.

In this embodiment, the side flaps need extend only a short distance inwardly of the front panel thereby terminating short of an adjacent vertical score line on the back panel as the front and back panels are secured at the corners without any gaps there between.

The envelope construction may be readily made from a single blank which can be pre-scored and provided with fold lines. In addition, the equipment for folding the blank may be of simple construction. For example, the equipment may be automated to have a folding station in which flaps on the sides of a panel of blank are folded over onto the panel, a gluing station in which adhesive is applied to the folded over flaps and a second folding station in which another panel of the blank is folded over and secured to onto the side flaps to form a pocket. A further station may be used to apply adhesive or another type of securing means to the closure flap.

These and other objects and advantages of the invention will become more apparent from the following detailed description taken in conjunction with the accompanying drawings wherein.

Figure 9:
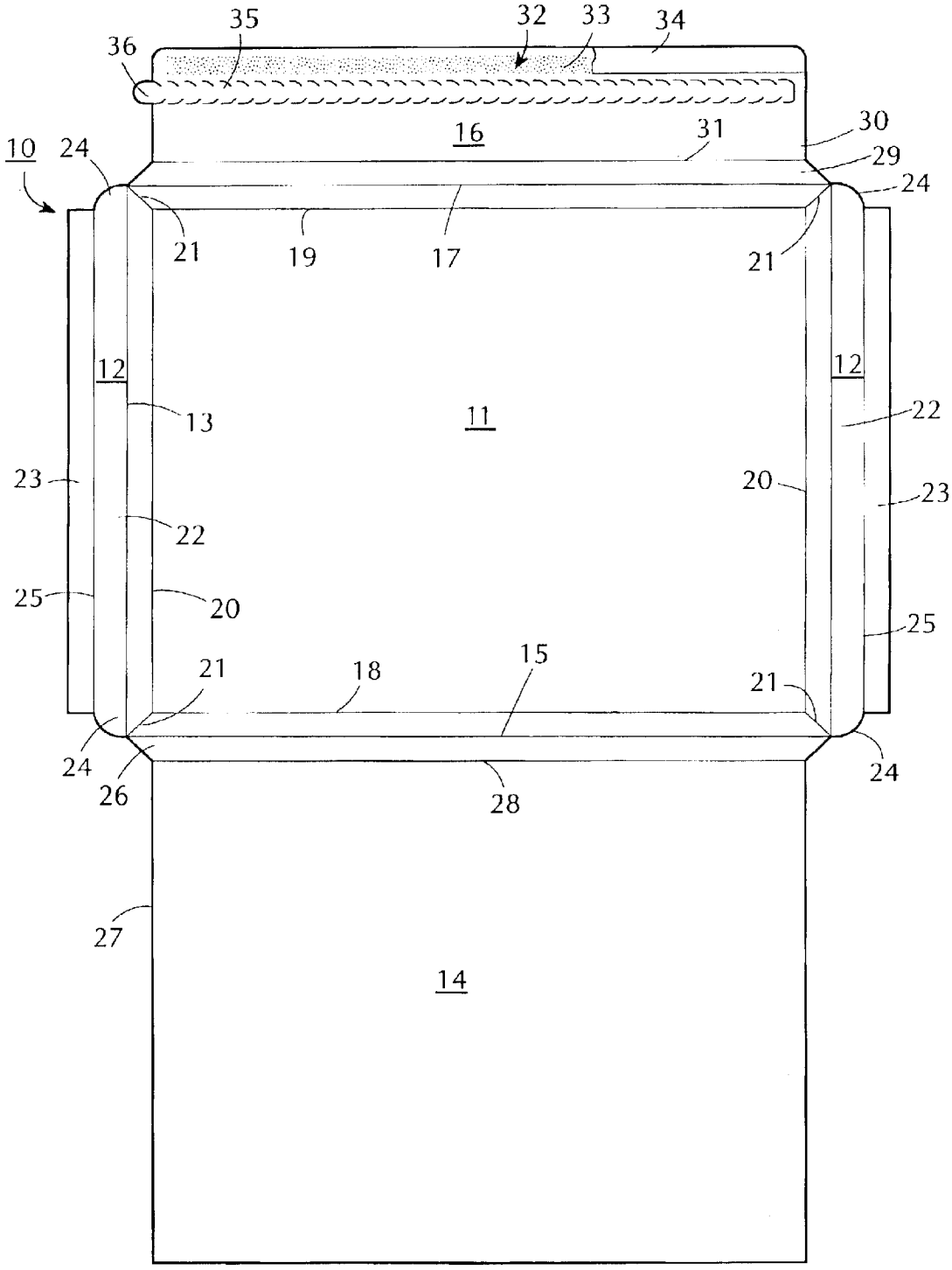
FIG. 9 illustrates a view of a blank for making the envelope construction of FIG. 1.

Referring to FIG. 9, the expandable envelope construction is made from a single blank 10 of paper or cardboard. As shown, the blank 10 has a rectangular panel 11 which is to define the front face of the envelope construction, a pair of flaps 12 at the opposite sides of the panel 11 for folding over along a vertical fold line 13 therebetween, a back panel 14 which extends from and which is to be folded over the front panel 11 along a horizontal fold line 15 there between to form a pocket and a closure panel 16 which is to define a closure flap and which extends from the front panel 11 along a horizontal fold line 17 therebetween for folding over the back panel 14 to close the pocket.

The front panel 11 has a horizontally disposed score line 18 spaced from a bottom edge, for example, the score line may be spaced one half inch from the bottom edge. The front panel 11 also has a horizontally disposed score line 19 spaced, for example, one half inch from the top edge, as well as a pair of vertically disposed score lines 20 each spaced, e.g. one half inch from the respective edge. In addition, a plurality of angularly disposed score lines 21 are also provided in the front panel 11 with each angularly disposed score line 21 extending from an intersection of a horizontal score line 18, 19 with a vertically disposed score line 21 to a corner of the front panel.

Each side flap 12 includes a first section 22 which extends from a vertical fold line 13 and a reduced second section 23 which extends from the first section 22. As shown, the first section 22 is of the same height as the front panel 11 and has a rounded corner 24 at each end so as to taper inwardly toward the reduced section 23 for purposes as described below. The reduced section 23 is of a height which is sufficient to act as a glue strip to enable securement of the closure flap 14 in place to close the pocket of the envelope construction.

Each sid flap 12 also has a vertically disposed score line 25 spaced fro the fold line 13 and defining the boundary between the two sections 22, 23 of the flap 12.

The back panel 14 has a trapezoidal section 26 which extends from the fold line 15 and a reduced rectangular section 27 which extends from the trapezoidal section 27. The back panel 14 also has a horizontally disposed score line 28 defining a boundary between the two sections 26, 27 which is spaced from the fold line 15 between the front and back panels, for example at a spacing of one-half inch. The trapezoidal section 26 is of a width so that when folded over the side flaps 12, the triangular ends of the trapezoidal section 26 overlie the rounded corners 24 of the first sections of the side flaps 12. The rectangular section 27 is of a width to overlie the score lines 25 on the side flaps 12 as well as a small part of the first section 22 of each side flap 12 and is of a height to extend to the height of the first section 22 of each side flap 12, that is to the juncture between the two sections 22, 23 of the side flaps 12.

The closure flap 16 has a first trapezoidal section 29 extending from the front panel 11, a reduced rectangular section 30 extending from the trapezoidal section 29 and a horizontal score line 31 parallel to the fold line 17 and defining a boundary between the two sections 29, 30. The trapezoidal section 29 is of a width so that when folded over the side flaps 12, the triangular ends of the trapezoidal section 29 overlie the rounded corners 24 of the first sections 22 of the side flaps 12. The rectangular section 30 has a width which is equal to the width of the rectangular section 27 of the closure flap 13 for closing the pocket of the envelope construction.

The closure flap 16 includes means 32 for securing the flap 16 to the back panel 14 in order to close the pocket. The securing means 32 may be in the form of an adhesive strip 33 which is covered over by a releasable barrier strip 34 of known construction. In this respect, once the barrier strip 34 is removed, the adhesive strip 33 is exposed and can be used to seal the envelope construction in a closed condition.

The closure flap 16 also includes a horizontally disposed tear strip 35 between the securing means 32 and the score line 31. As shown, the tear strip 35 is provided with a tab 36 at one end which extends beyond the flap 16 for manual gripping thereof.

A suitable adhesive (not shown) is applied to the underside of the second sections 23 of the side flaps 12 so that when the side flaps 12 are folded over the front panel 11, back panel 14 can be secured thereto.

The blank 10 is suitably prescored with the score lines and fold lines and provided with the securing means 32 so that a stack of blanks may be supplied to automated equipment for processing into envelope constructions. For example, the equipment used to fabricate the envelope need only employ a side edge folding station for folding the side flaps 12 over, an adhesive applying station to apply adhesive to the folded over flaps 12 (and/or to the back panel 14) and a folding station for folding the back panel 14 onto the side flaps 12 for adhesion and securement thereto to form the finished envelope construction.

When fabricated the envelope construction is empty and flat.

Figure 1:
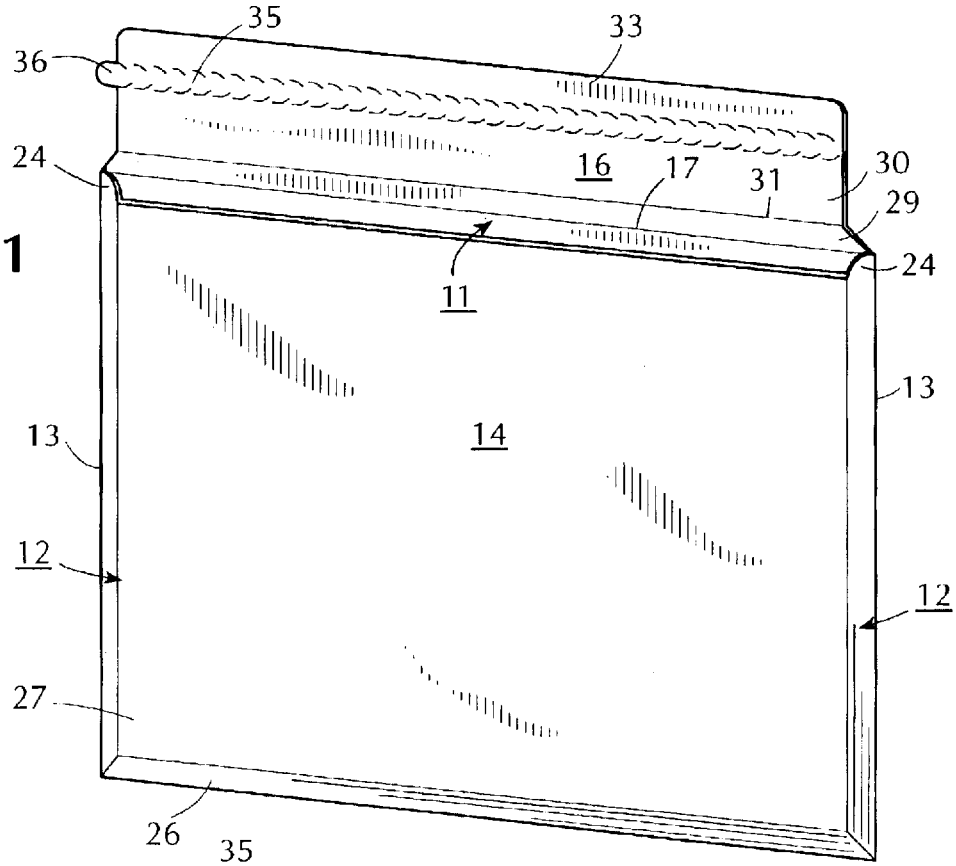
FIG. 1 illustrates a back perspective view of an envelope construction in accordance with the invention in an opened state.
Figure 2:
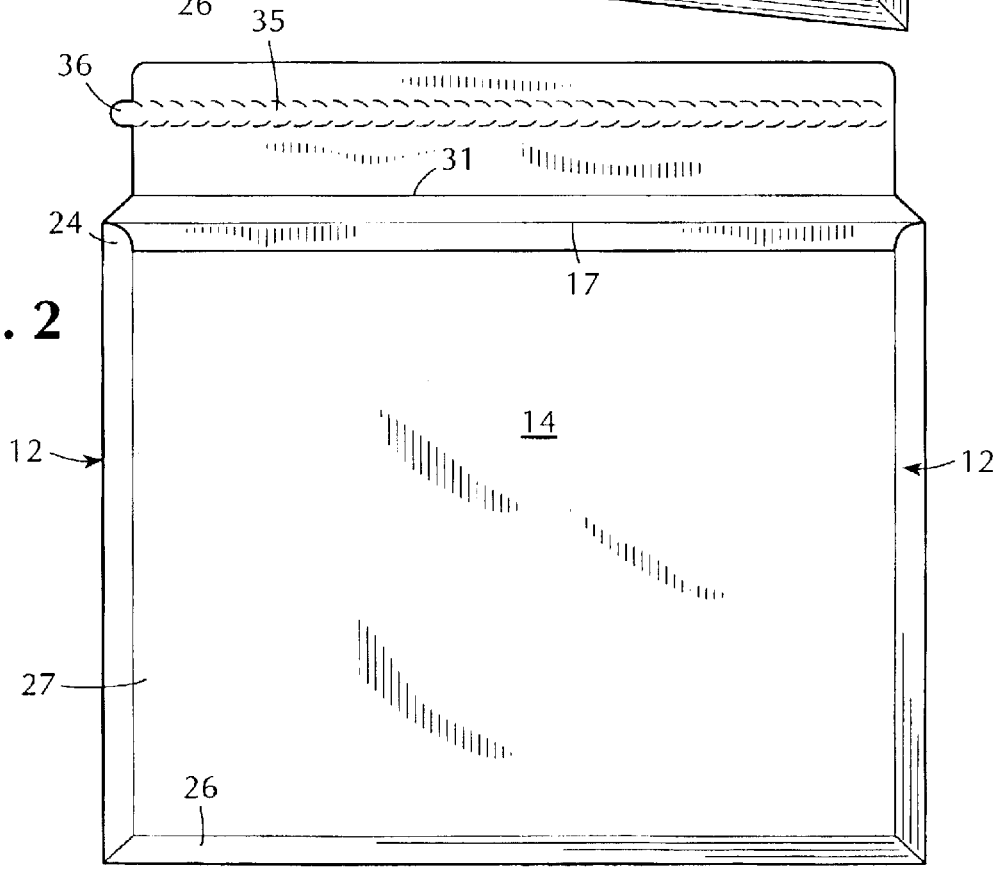
FIG. 2 illustrates a back view of the envelope of FIG. 1 in a flat and empty state.
Figure 3:
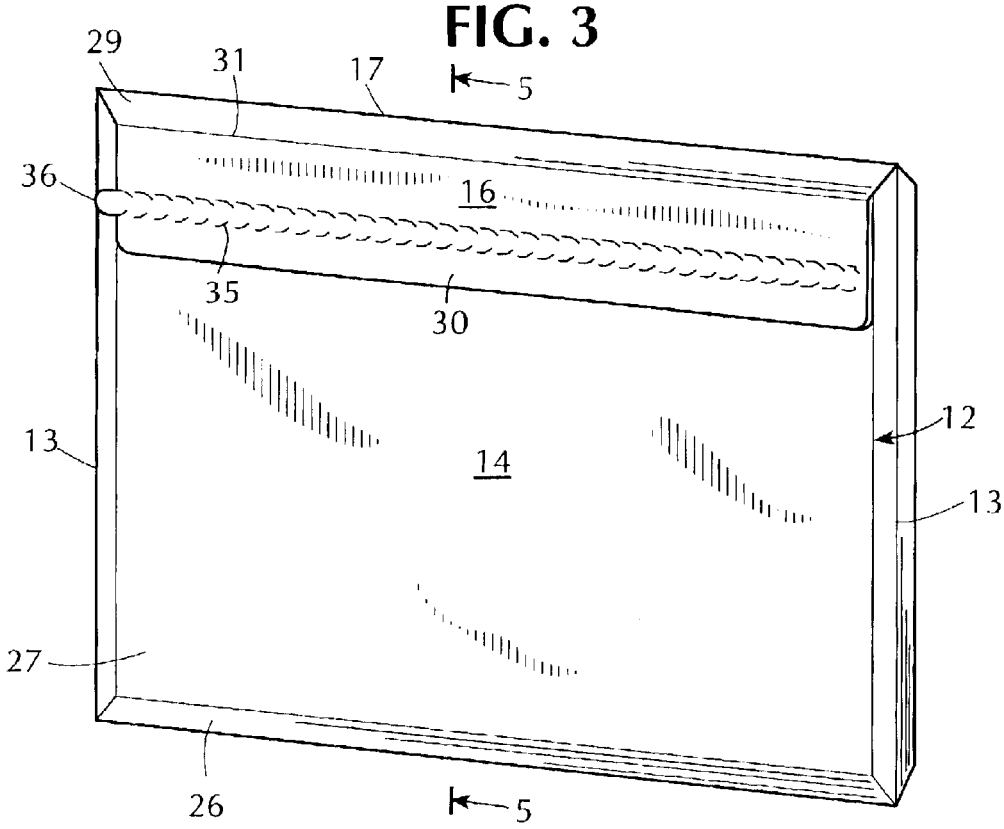
FIG. 3 illustrates a back view of the envelope of FIG. 1 in a closed and filled-to-capacity condition.
Figure 6:
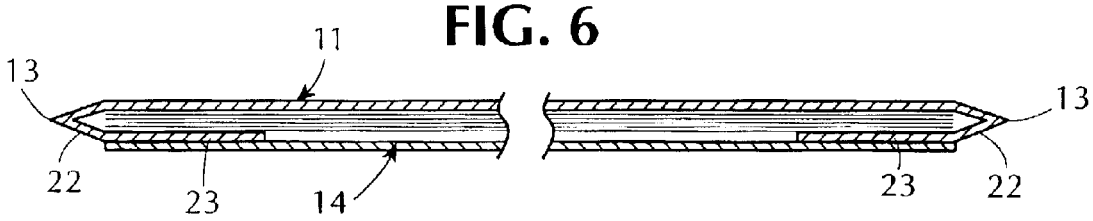
FIG. 6 illustrates a view taken on line 6—6 of FIG. 4.
Figure 4:
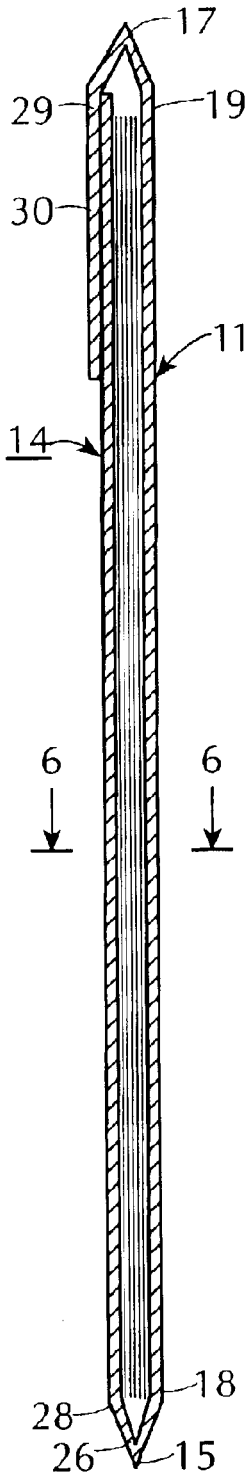
FIG. 4 illustrates a cross-sectional view of the envelope in a partially filled condition.
Figure 8:
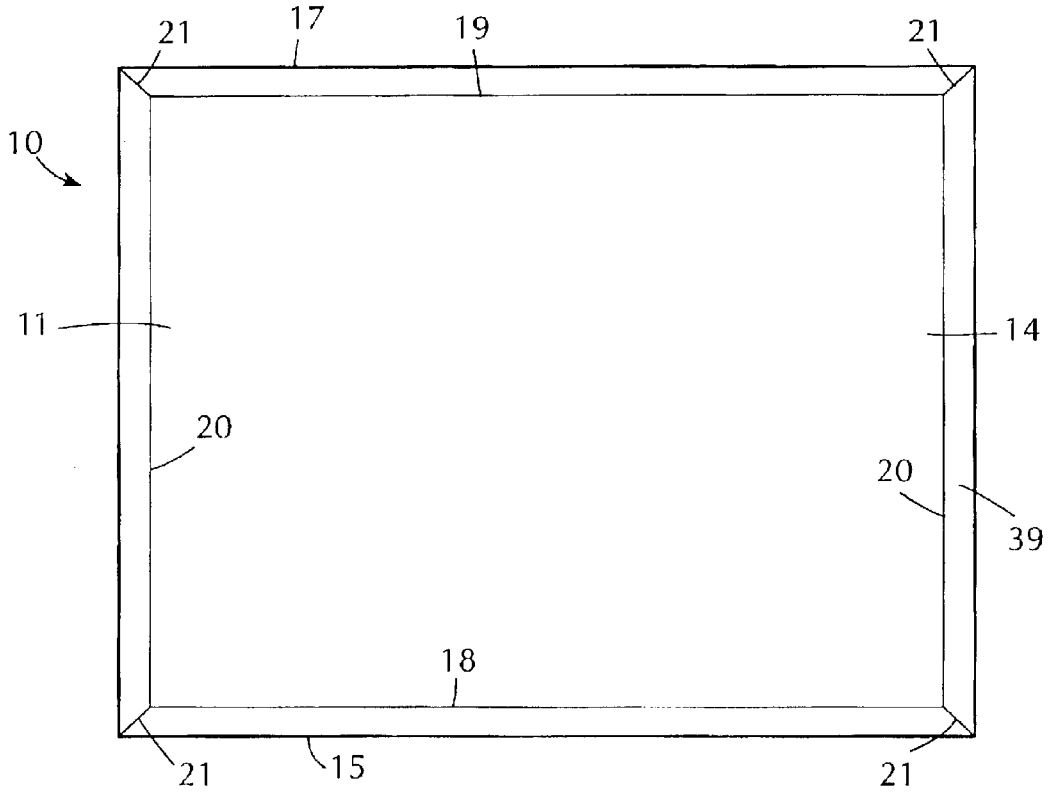
FIG. 8 illustrates a front view of the envelope construction of FIG. 3.

Referring to FIGS. 1 and 2, wherein like references indicate like parts as above, when the envelope construction is placed in use, the closure flap 13 is lifted as indicated in FIG. 1 and the pocket between the front panel 11 and the back panel 14 is opened to permit materials to be deposited into the pocket in a conventional manner. If, for example, a few sheets of paper 37 are inserted into the envelope, as indicated in FIGS. 4 and 6, the closure flap 16 is simply laid back over the back panel 14 and sealed thereto as indicated in FIG. 3. The overall appearance of the closed and partially filled envelope is that of a smooth flat envelope as shown if FIG. 8.

Figure 7:
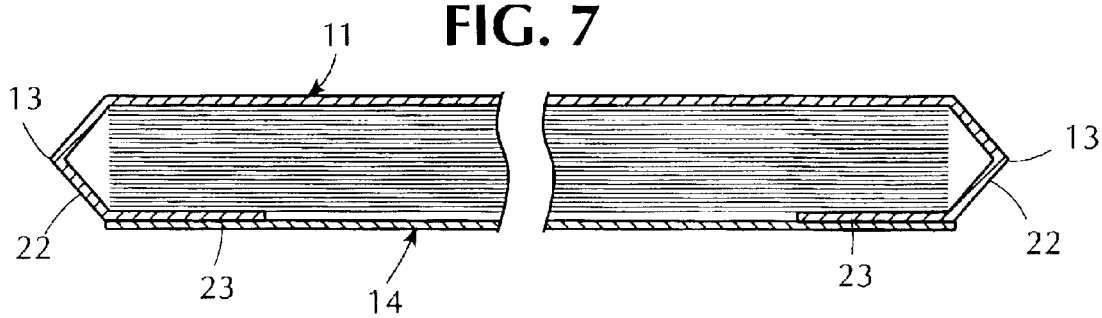
FIG. 7 illustrates a view taken on line 7—7 of FIG. 5.
Figure 5:
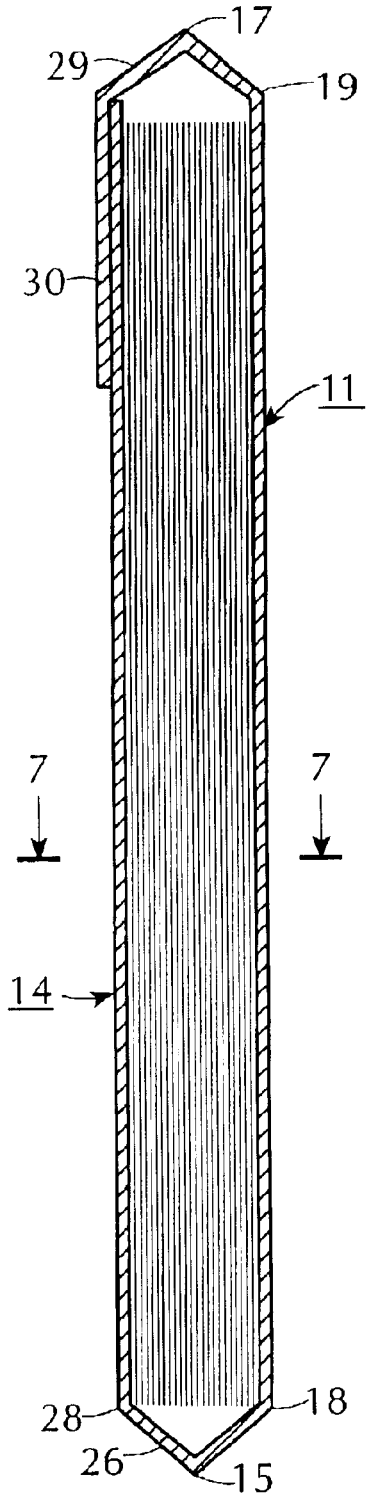
FIG. 5 illustrates a view taken on line 5—5 of FIG. 3.

In the event that the design capacity of the envelope is to be fully utilized, a stack of paper sheets, a magazine, a catalog or the like 38 of a thickness of one-half inch is stuffed into the pocket, as shown in FIGS. 5 and 7. At this time, the front and back panels 11,14 are expanded from each other so that the thickness of the pocket is enlarged as shown in FIG. 5 while at the same time, the width of the pocket is decreased. In this respect, as the front and back panels 11, 14 expand from each other, the two sides and bottom of the envelope construction collapse inwardly. Specifically, as the envelope expands in thickness e.g. from the partially filled condition of FIG. 4, to the full capacity condition of FIG. 5, the edge portions between a vertical score line 20,25 and a fold line 13 pivots inwardly about the score lines 20,25 thereby allowing the pocket to increase in thickness while also decreasing in width. During the expansion of the pocket, the ends of the trapezoidal section 26 of the back panel 14 which overlie the rounded corners 24 of the side flaps 12 and which are not secured thereto slide relative to the rounded corners while maintaining contact so as to maintain the pocket and the contents 37,38 in a sealed condition. At the same time, the ends of the trapezoidal section 29 of the closure flap 16 move relative to the rounded corners 24 at the tops of the side flaps 12 as these ends are likewise not secured to the rounded corners 24 so that a sealed condition is maintained at the top of the envelope construction. Instead of using rounded corners 24, any other type of an enlarged ear may be used.

After the envelope pocket has been filled, the barrier strip 34 on the closure flap 16 is removed to expose the adhesive strip 33 and the closure flap 13 brought down over the back panel 14 and sealed via the adhesive strip 33 to the back panel (FIG. 3).

The envelope construction may be made of various sizes to accommodate magazines, manuscripts, stacks of letter size papers, CD carriers and the like.

In order to open the envelope, the tear-strip 35 is simply manually removed from the closure flap 16 leaving the remainder of the flap 16 free to be folded back so that the contents in the pocket may be removed.

For purposes of enhancing the appearance of the construction, the edge margins of the envelope construction on each side may be provided with shading 39 (see FIGS. 1 and 8) from each edge of the envelope construction to the adjacent score line.

Referring to FIG. 3, where the back panel 14 is secured to and over the side flaps 12, the back panel 14 and the folded over side flaps 12 constitute a back face of the envelope construction. Alternatively, the back panel 14 may constitute the front face of an envelope construction, for example where address and mailing information is provided on the back panel.

Hence, the term "face" is used simply as a matter of reference to the embodiment illustrated in the drawings.

Figure 20:
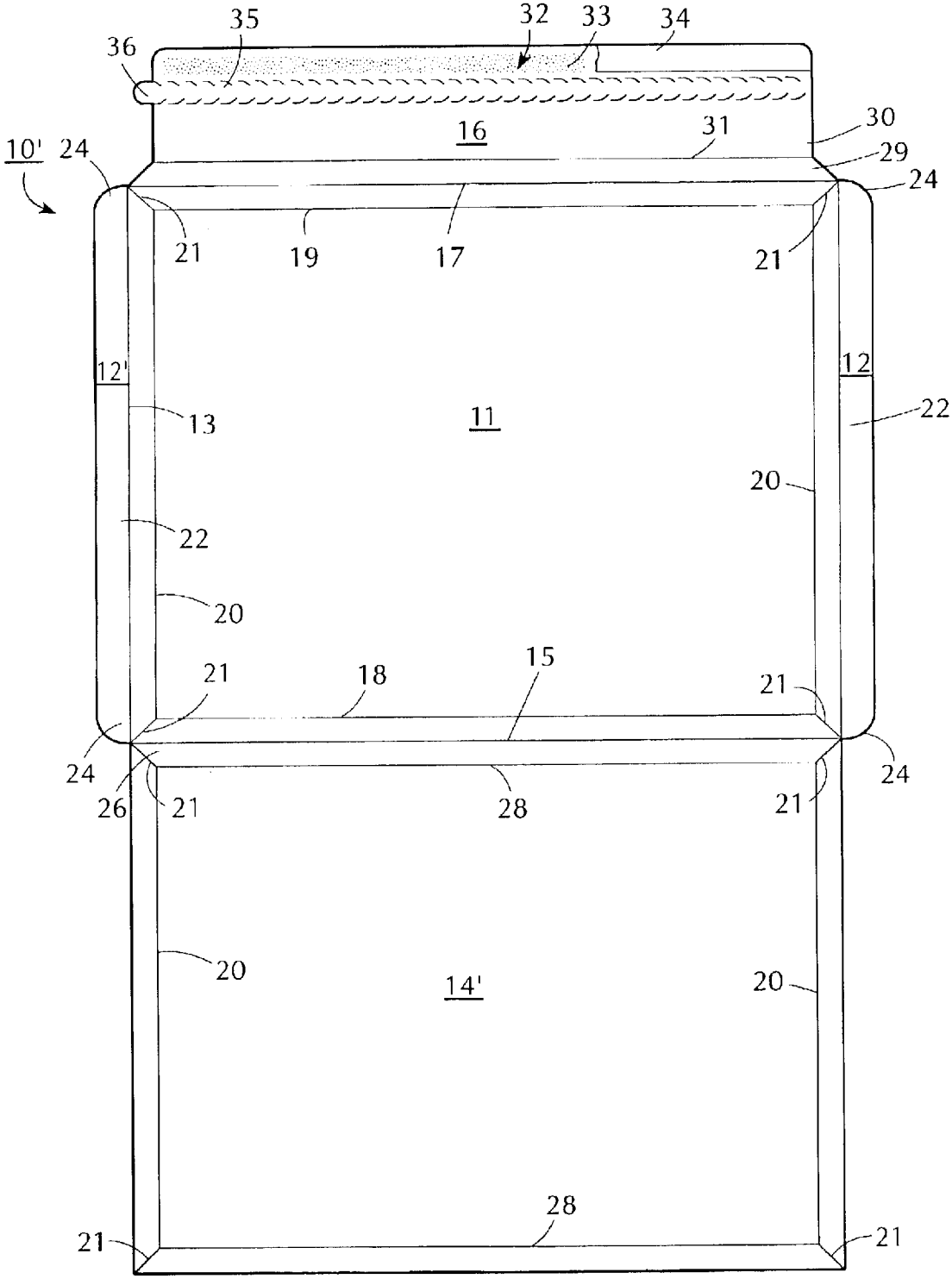
FIG. 20 illustrates a view similar to FIG. 9 of a blank for making a modified envelope construction in accordance with the invention.

In another embodiment, as shown in FIG. 20 wherein like reference characters indicate like parts as above, the blank 10' for forming the envelope construction may employ side flaps 12' of limited width. In case, the envelope construction may have a front panel 11 constructed, as above, and a back panel 14' of the same width and approximately the same height. In addition, the back panel 14' is provided with a rectangular frame of score lines, i.e. a pair of parallel vertical score lines 20 and a pair of parallel horizontal score lines 28 as well as angularly disposed score lines 21 which extend from the intersections of the horizontal and vertical score lines to a corner of the back panel. In construction, the side flaps 12' extend to a point which terminates short of the vertical score lines 20 of the back panel 14'.

The closure flap for this embodiment may have the same construction as the closure flap as in the illustrated embodiment.

It is to be noted that the closure flap may have any suitable configuration. For example, instead of having a rectangular configuration as illustrated in FIG. 3, the flap may have a trapezoidal shaped end section, a rounded terminal end section or any other conventional shape.

In order to reuse the envelope, the closure flap may be provided with a means (not shown) for reclosing the flap over the back panel. Such a means may include a ribbon, such as used on a conventional red rope folder. Alternatively, the means for reclosing the envelope construction may be in the form of an adhesive strip which is covered over by a releasable barrier strip. Thus, upon removal of the barrier strip the exposed adhesive may be used to reseal the envelope.

In other embodiments the means for securing the closure flap may be of reusable nature, for example, Velcro type elements or strips may be used.

Figure 10:
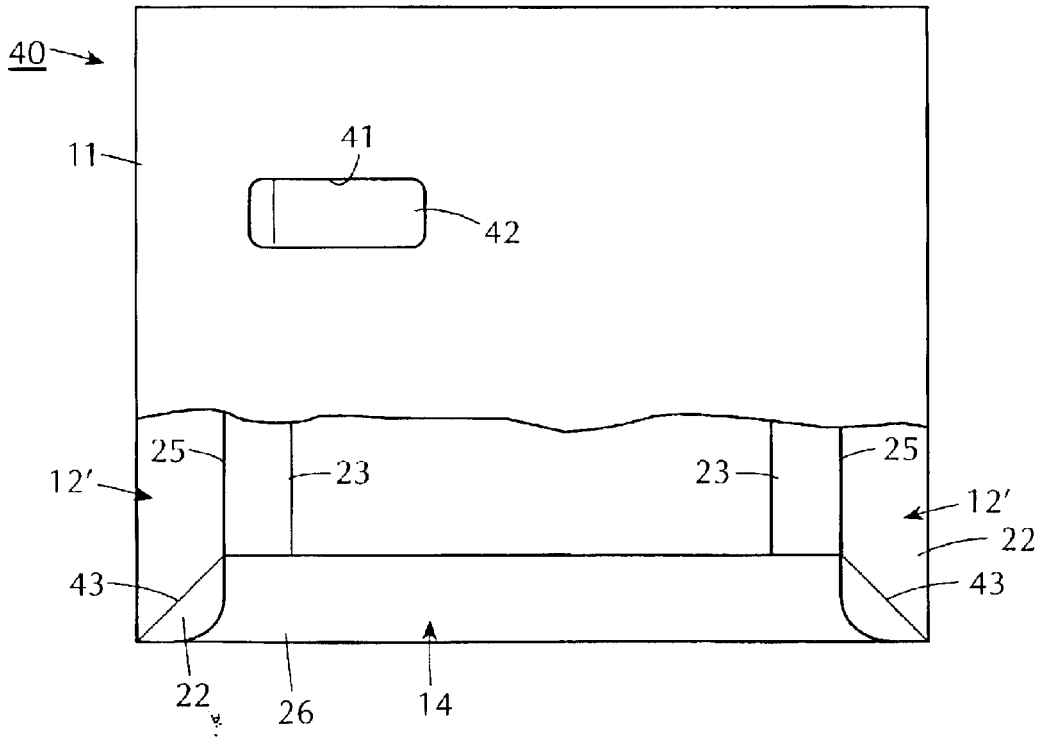
FIG. 10 illustrates a part fragmentary view of a modified envelope construction having a smooth front panel with a window and a scored back panel in accordance with the invention.

Referring to FIG. 10, wherein like reference characters indicate like parts as above, the envelope construction 40 has a rectangular front panel 11 which is provided with a window 41 for viewing the contents of the envelope construction 40. In addition, a glassine patch 42 is secured to an inside surface of the front panel 11 over the window 41 in order to protect the contents of the envelope construction 40.

The front panel 11 is smooth and uninterrupted by score lines, a pair of side flaps 12' are secured to opposite sides of the front panel 11 and a back panel 14 is secured to the flaps 12'.

Each side flap 12' includes a first section 22 which extends inwardly from the front panel 11 and a reduced second section 23 which extends from the first section and is secured to the back panel 14. In this embodiment, the first section 22 has a score line 43 extending from a vertically disposed score line 25 between the two sections 22, 23 to a corner of the envelope construction 40. This score line 43 is aligned with a side edge of a trapezoidal section 26 of the back panel 14.

The envelope construction 40 is particularly suitable to receive a packet of materials with a wrap-around letter about the packet of materials wherein an address on the wrap-around letter is viewable through the window 41. The envelope construction 40 is otherwise of similar construction to the envelope construction of FIGS. 1 to 9. In this respect, the construction 40 includes a closure flap (not shown) having means securing the flap to the back panel 14 and a removable strip, for example, employing a rip strip, the closure flap.

The envelope construction 40 is particularly suitable for situations in which the user does not wish to show score lines on the mailing side of the envelope construction.

Figure 11:
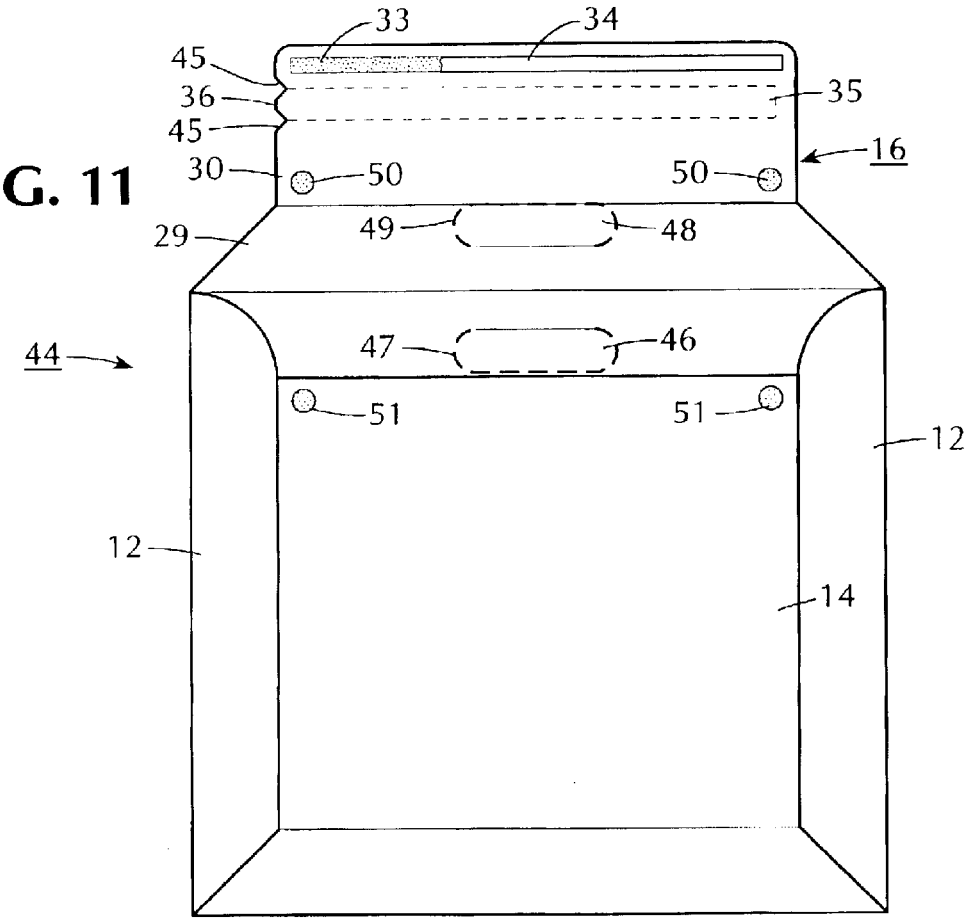
FIG. 11 illustrates a back view of a reusable carry pack envelope construction in accordance with the invention.
Figure 12:
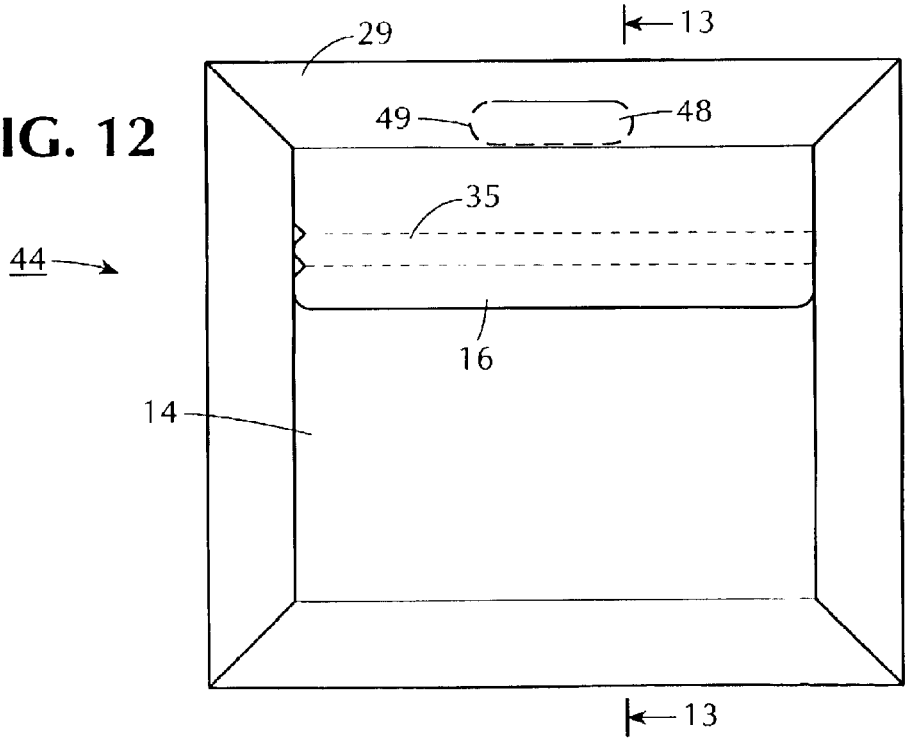
FIG. 12 illustrates a back view of the construction of FIG. 11 in a closed condition.
Figure 17:
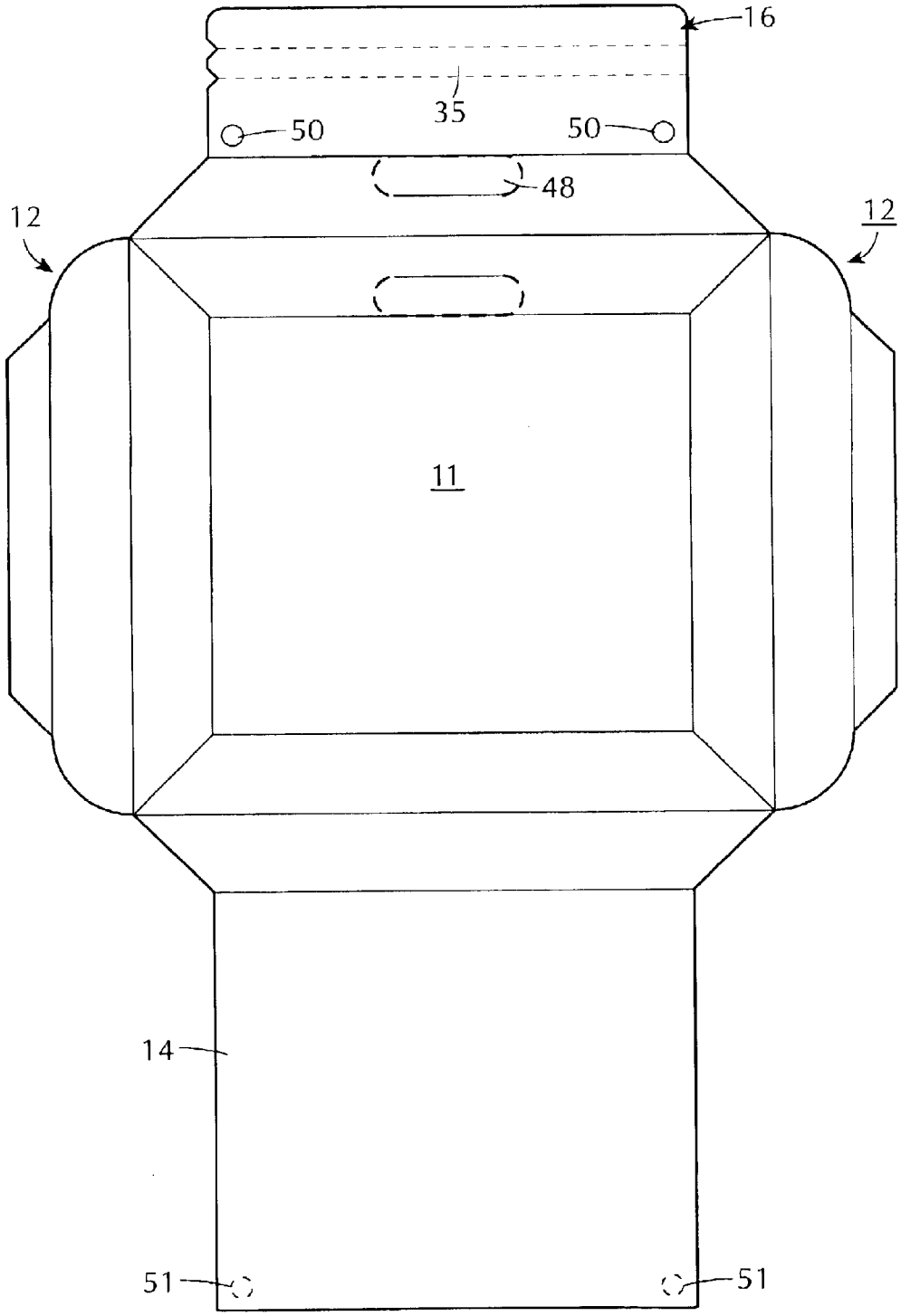
FIG. 17 illustrates a view of a blank for making a construction of FIG. 11.

Referring to FIGS. 11, 12 and 17, wherein like reference characters indicate like parts as above, the envelope construction 44 may be sized for use as a reusable carry pack. In this construction, the material used may be a F-flute corrugated material, an E-flute corrugated material or similar stiff material.

The envelope construction 44 is made from a single blank (FIG. 17) and is suitably sized to receive large thickness of material. For example, the envelope construction 44 has dimensions of 14⅝ inches by 13⅜ inches with the score lines disposed so that the envelope construction 44 may receive a one inch thick 3-ring binder.

The envelope construction 44 includes a removable strip 35 which carries a tab 36 at one end. As indicated, the closure flap 16 is provided with a pair of cut-outs 45 to space the tab 36 from the remainder of the closure flap 16 for ready access without the tab 36 projecting beyond the side edge of the closure flap 16.

Figure 15:
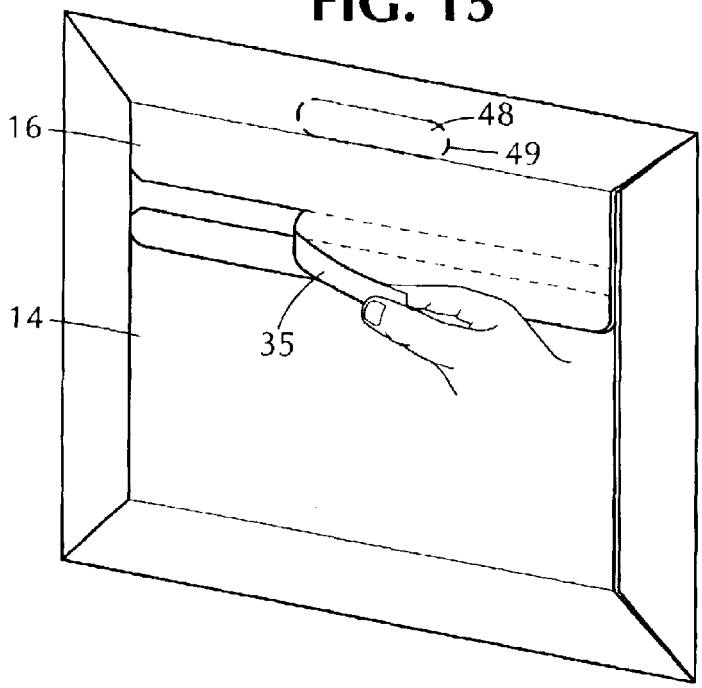
FIG. 15 illustrates a perspective back view of the reusable construction of FIGS. 11 and 12 during opening.

The removable strip 35 is perforated along two longitudinal sides to be readily removed from the remainder of the closure flap 16 upon manual removal thereof as indicated in FIG. 15. As also shown in FIG. 11, the removal strip 35 terminates short of the right hand side of the closure flap 16.

The front panel 11 is provided with a hinged blank 46 which is defined by a perforation 47 of part-oval shape so that the blank 46 is hinged along one longitudinal side to the front panel 11. The trapezoidal section 29 of the closure flap 16 is provided with a similar blank 48 which is defined by a perforation 49 of oval shape so as to be hinged along one longitudinal side to the remainder of the closure flap 16. The two blanks 46, 48 are aligned with each other.

Figure 16:
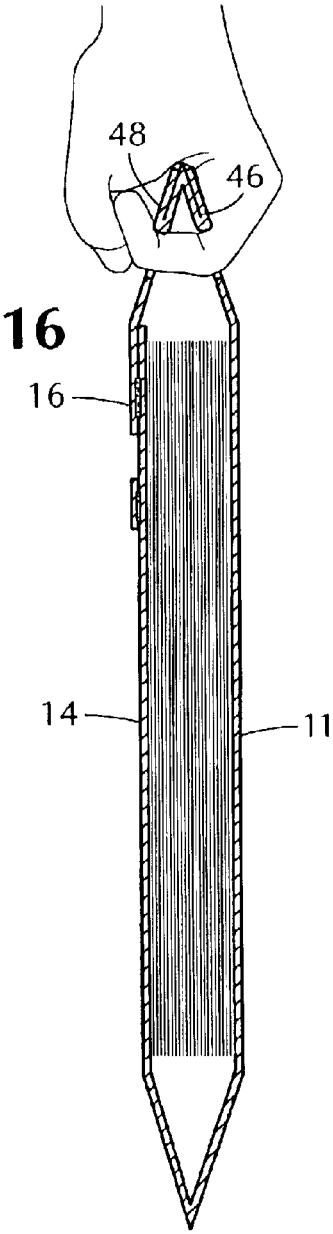
FIG. 16 illustrates a cross-sectional view of the construction of FIG. 15 during use as a carry pack.

Referring to FIG. 16, each blank 46, 48 may be punched out about the respective perforation 47, 49 and folded back as shown in FIG. 16 to form a four-ply handle.

Referring to FIG. 11, the closure flap 16 and the back panel 12 are provided with cooperating Velcro elements 50, 51, respectively for releasably securing the closure flap 16 to the back panel 12 after removal of the strip 35. As illustrated, the Velcro elements 50 are disposed on the rectangular portion 30 of the closure flap 16 between the removable strip 35 and the trapezoidal section 29 of the closure flap 16.

Figure 13:
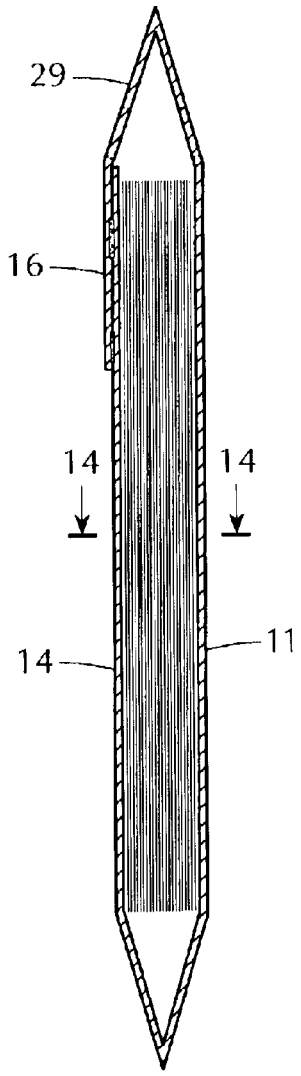
FIG. 13 illustrates a view taken on line 13—13 of FIG. 12.
Figure 14:
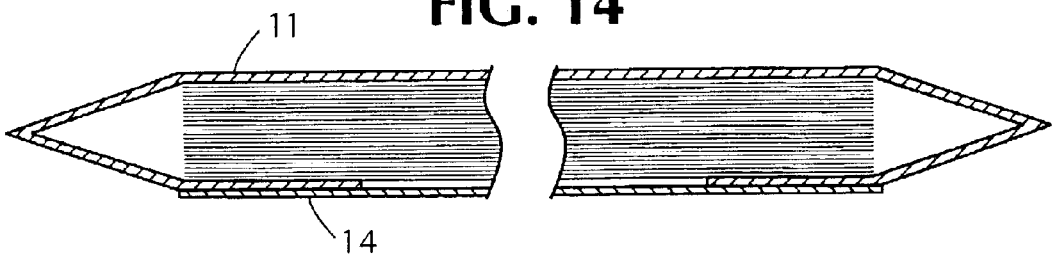
FIG. 14 illustrates a view taken on line 14—14 of FIG. 13.

In use, the envelope construction 44 may be stuffed with a ring binder or other materials of relatively large thickness as indicated in FIGS. 13 and 14. After removal of the barrier strip 34, the closure flap 16 is folded over the back panel 12 and the adhesive strip 33 is used to seal the closure flap 16 to the back panel 12.

Upon receipt of the stuffed envelope construction 44, the recipient would remove the strip 35 from the closure panel 16 as indicated in FIG. 15. The closure flap 16 may then be folded back so that the materials within the envelope construction 44 may be removed. If desired, the materials may then be placed back into the pocket of the envelope construction 44 and the remainder of the closure flap 16 folded back over the back panel 12 for securement thereto via the Velcro elements 50, 51 as indicated in FIG. 16.

For purpose of transportation, the two blanks 46, 48 may then be punched out and folded back as indicated in FIG. 16 to form a four-ply handle for manual grasping.

Figure 18:
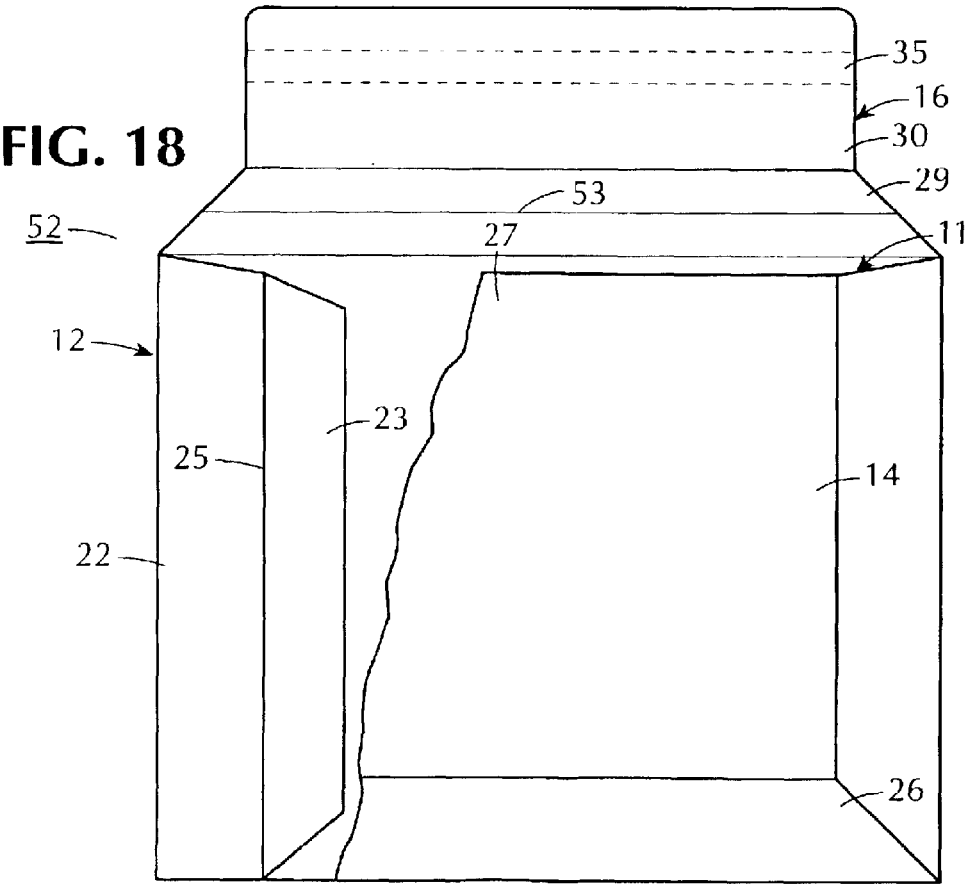
FIG. 18 illustrates a part fragmentary rear view of a modified envelope construction in accordance with the invention.

Referring to FIG. 18, the envelope construction 52 may also be constructed to include expansion scores on only one side so that the mailing side does not show scores. In this embodiment, wherein like reference characters indicate like parts as above, the front panel 11 is smooth and uninterrupted.

The dimensions of the envelope construction 52 are 10 inches by 7 inches. In this construction, each side flap has a pair of sections 22, 23 separated by a score line 25 while the back panel 14 has a rectangular section 27 secured to each trapezoidal section 23 between the score lines 25 of the two side flaps 12. The trapezoidal section 26 of the back panel is not secured to the side flaps 12.

In addition, the closure flap 16 has a first trapezoidal section 29 extending from the front panel 11. This trapezoidal section 29 is divided by a horizontal score line 53. As indicated, the rectangular section 30 of the closure flap is of an extended length so as to allow the closure flap 16 to extend downwardly onto the back panel 14 a distance more than one-half of the height of the back of the envelope construction 52.

Figure 19:
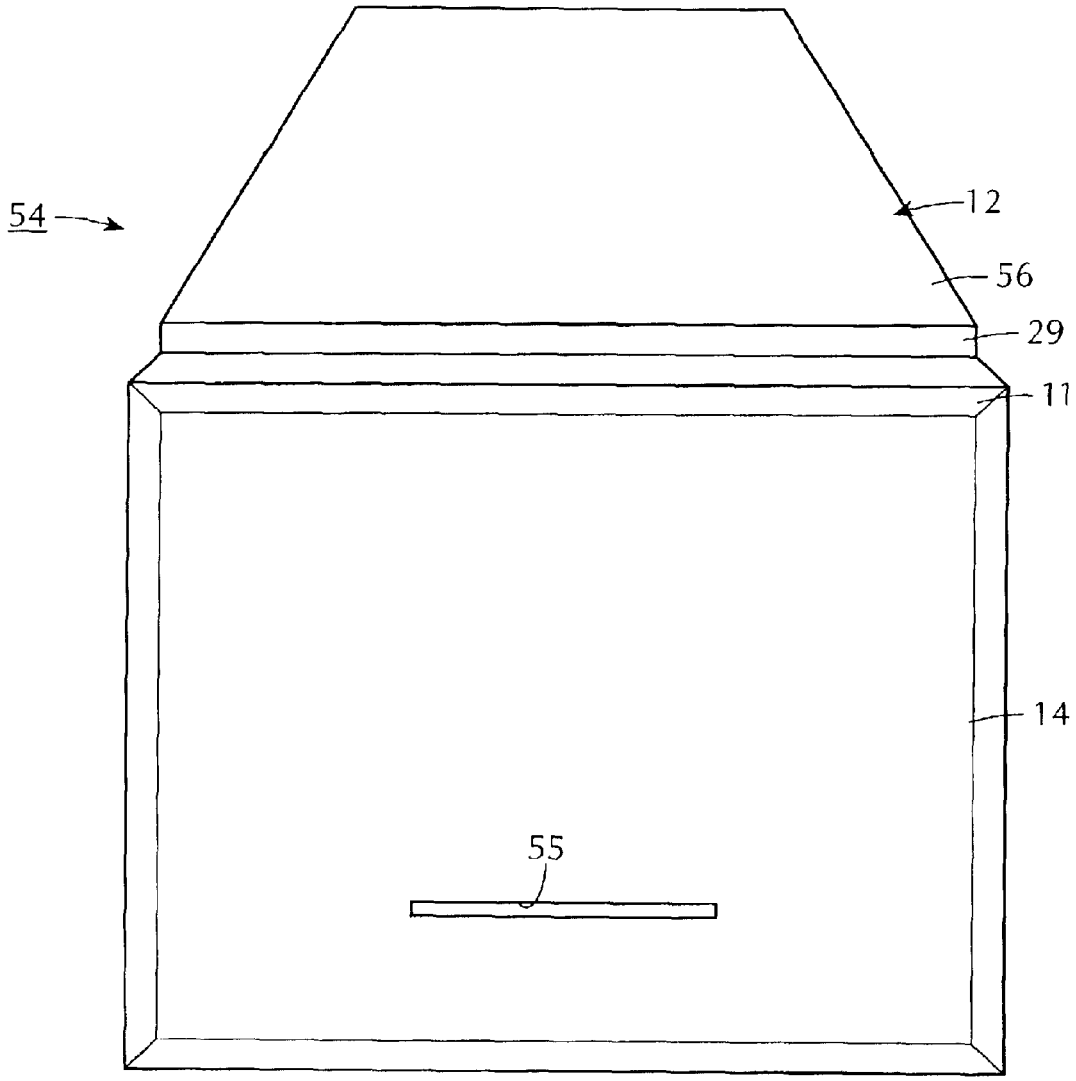
FIG. 19 illustrates a rear view of a further modified construction in accordance with the invention.

Referring to FIG. 19, wherein like reference characters indicate like parts as above, the envelope construction 54 may be constructed as a folder rather than as a mailer. For example as shown, the back panel 14 is made with a horizontally disposed slot 55 near the bottom while the closure flap 12 has a trapezoidal section 56 of elongated length to fit into the slot 55 when the closure flap 12 is disposed over the back panel 14. This construction is particularly suitable as a folder which can be opened and closed multiple times by the user.

In this embodiment, the envelope construction 54 is not provided with any means for adhesively securing the closure flap 12 to the back panel 14. Further, the closure flap 12 may be shaped other than as shown in order to fit into the slot 55 in the back panel 14.

The various embodiments of the envelope construction may be made of any suitable materials. For example, in order to enhance the appearance of an envelope construction, the material may be embossed. This may be particularly attractive where the envelope construction is used to receive a similarly embossed folder.

The various envelope constructions described above may also be provided with perforated lines of weakening between the closure flap 12 and the front panel 11 in order to facilitate folding of the closure flap 12 onto the back panel 14. This is particularly useful where the material of the construction is made of a heavier or stiff material, such as corrugated material.

The invention thus provides an expandable envelope construction which is able to expand while still appearing flat. That is to say, the envelope construction looks just as good with one sheet of paper or when filled to capacity as opposed to other expandable envelopes which look good only when filled to capacity. Further, the envelope construction utilizes less space than a gusseted expandable envelope of conventional construction. Further, the expense of the envelope construction is less than that of a gusseted envelope.

The invention further provides an envelope construction which can be easily made by using of a single blank on automated equipment.

The invention also allows papers and the like inserts to be stuffed into the expandable envelope without interference from internally disposed gussets.

What is claimed is:

1. An expandable envelope construction comprising a pair of panels folded over each other along a horizontal fold line;

at least a first panel of said panels having a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective corner of said first panel;

a pair of side flaps at opposite sides of one of said pair of panels, each said flap being folded over said one panel along a vertical fold line therebetween and being secured to the other of said pair of panels to form a pocket; and a closure flap extending from said one of said pair of panels along a horizontal fold line therebetween for folding over the other of said pair of panels to close said pocket, said closure flap having a horizontally disposed score line spaced from said fold line between said closure flap and said one of said pair of panels whereby upon insertion of materials into said pocket, said panels are expandable from each other to enlarge the thickness of said pocket while said pocket is maintained in a sealed condition.

2. An envelope construction as set forth in claim 1 wherein each of said panels has a horizontally disposed score line spaced from a bottom edge thereof, a horizontally disposed score line spaced from a top edge thereof, a vertically disposed score line spaced from one side edge thereof, a vertically disposed score line spaced from another side edge thereof and a plurality of angularly disposed score lines, each said angularly disposed score line extending from an intersection of a respective horizontally disposed score line and a vertically disposed score line to a respective corner of said each panel.

3. An envelope construction as set forth in claim 2 wherein each said side flap terminates short of an adjacent vertical score line of said other panel of said pair of panels.

4. An expandable envelope construction as set forth in claim 1 wherein each said side flap is disposed between said pair of panels.

5. An expandable envelope construction as set forth in claim 1 wherein the other of said panels is secured to each said flap in overlapping relation to seal said pocket at at least each of two corners of the envelope construction.

6. An expandable envelope construction as set forth in claim 1 wherein said pair of panels are of equal width.

7. An expandable envelope construction as set forth in claim 6 wherein each said side flap is disposed between said pair of panels.

* * * * *

UNITED STATES PATENT AND TRADEMARK OFFICE

CERTIFICATE OF CORRECTION

PATENT NO. : 6,820,799 B2
DATED : November 23, 2004
INVENTOR(S) : Marvin A. Makofsky It is certified that error appears in the above-identified patent and that said Letters Patent is hereby corrected as shown below:

Column 5,
Line 49, “sid” should be -- side --
Line 50, “fro” should be -- from --

Column 7,
Lines 44 and 52, after “In” insert -- this --

Column 12,
Line 3, “said flap” should be -- said side flap --

Signed and Sealed this

Twenty-second Day of February, 2005

JON W. DUDAS
*Director of the United States Patent and Trademark Office*